United States Patent [19]

Kitamura

[11] Patent Number: 4,758,472

[45] Date of Patent: Jul. 19, 1988

[54] HIGH TENACITY POLYHEXAMETHYLENE ADIPAMIDE FIBER

[75] Inventor: Kazuyuki Kitamura, Nobeoka, Japan

[73] Assignee: Asahi Kasei Kogyo Kabushiki Kaisha, Tokyo, Japan

[21] Appl. No.: 97,418

[22] Filed: Sep. 15, 1987

Related U.S. Application Data

[63] Continuation of Ser. No. 805,416, Dec. 6, 1985, abandoned, which is a continuation of Ser. No. 511,182, Jul. 6, 1983, abandoned.

[30] Foreign Application Priority Data

Jul. 8, 1982 [JP] Japan ..... 57-117786
Apr. 28, 1983 [JP] Japan ..... 58-73736

[51] Int. Cl.[4] ..... D02G 3/00

[52] U.S. Cl. ..... 428/364; 57/902; 152/451; 264/210.8; 428/292; 428/395

[58] Field of Search ..... 428/364, 292, 394, 395, 428/359; 152/359; 57/902; 264/210.8, 210.1

[56] References Cited

U.S. PATENT DOCUMENTS

| | | |
|---|---|---|
| 2,807,863 | 10/1957 | Schenker . |
| 3,090,997 | 5/1963 | Au . |
| 3,091,015 | 5/1963 | Zimmerman . |
| 3,093,881 | 6/1963 | Zimmerman . |
| 3,311,691 | 3/1967 | Good . |
| 3,361,859 | 1/1968 | Cenzato . |
| 3,548,584 | 12/1970 | Silverman et al. . |
| 3,551,548 | 12/1970 | Brignac et al. . |
| 3,551,549 | 12/1970 | Sundbeck . |
| 3,562,206 | 2/1971 | Silverman et al. . |
| 3,651,201 | 3/1972 | Brignac et al. . |
| 3,716,611 | 2/1973 | Chapman . |
| 4,009,511 | 3/1977 | Gauntt . |

FOREIGN PATENT DOCUMENTS

| | | | |
|---|---|---|---|
| 666693 | 7/1963 | Canada | 428/364 |
| 1179370 | 4/1957 | Fed. Rep. of Germany . | |
| 1520333 | 9/1963 | Fed. Rep. of Germany . | |
| 1803432 | 10/1969 | Fed. Rep. of Germany . | |
| 1560921 | 3/1969 | France . | |
| 7251 | 6/1964 | Japan . | |
| 26207 | 1/1965 | Japan . | |
| 48-12085 | 4/1973 | Japan . | |
| 32616 | 4/1973 | Japan . | |
| 1238488 | 4/1969 | United Kingdom . | |

OTHER PUBLICATIONS

Simpson P. et al., "Nylon 6, 6 Fiber Tensile Properties as a Function of Morphology," Textile Research Journal, Feb. 1981.

Murayana, T. et al., "Dynamic Mechanical Properties of High Molecular Weight Nylon 66 Fiber," Journal of Polymer Science II, pp. 1873–1878, (1973).

Falkai, B., "Synthesefasern," Verlag Chemie, p. 118, (1981).

Future Organic Tire Fibers, Journal of Applied Polymer Science, vol. 17, pp. 2039–2051, (1973).

*Primary Examiner*—Lorraine T. Kendell

*Attorney, Agent, or Firm*—Finnegan, Henderson, Farabow, Garrett & Dunner

[57] ABSTRACT

A high tenacity polyhexamethylene adipamide fiber having:

(1) a formic acid relative viscosity of 70 or more than 70;

(2) a tenacity of at least 10 g/d; and (3) a coefficient of stability of tie molecule of at most 0.20.

5 Claims, 2 Drawing Sheets

HIGH TENACITY POLYHEXAMETHYLENE ADIPAMIDE FIBER

This application is a continuation of application Ser. No. 805,416, filed Dec. 6, 1985, now abandoned; which is a continuation of application Ser. No. 511,182 filed July 6, 1983, now abandoned.

TECHNICAL FIELD

This invention relates to high tenacity polyhexamethylene adipamide fibers. More particularly, it relates to high tenacity polyhexamethylene adipamide fiber having a tenacity of 10 g/d or more and a less reduced tenacity during after-treatments, particularly after vulcanization and a process for their production.

BACKGROUND ART

Since polyhexamethylene adipamide fibers are superior in tenacity, toughness, heat-resistance, dyeability and coloration, they are broadly used as fibers for industrial materials, interior cloth, bed cloth and clothing. Especially, on account of their excellent tenacity, toughness, heat resistance, fatigue resistance and adhesion to rubber, the polyhexamethylene adipamide fibers are broadly used as fibers for tire cords.

Recently an energy saving technology is required of tires and tires which can save driving fuel are desired. For this reason, tire makers are pursuing tires which have lower rolling resistance and are lighter. Thus tire cords having higher modulus and higher tenacity are required, too. Particularly, polyamide tire cords are mainly used for tires of large size with a number of plies of embedded fabrics, i.e., for light trucks, truck-buses, construction vehicles, airplanes and the like. Accordingly, there is a problem that the number of yarns employed per tire is large. Reduction in the number of plies or ends of embedded fabrics can achieve not only saving of fuel due to lightening of tires but also improved fatigue-resistance due to decrease in heat-generation and increase in heat-exhaustion, improved safety for separation due to improved adhesiveness and improved productivity in the manufacturing process of tires. Thus, higher tenacity polyamide tire cords are demanded. At present, polyamide fibers on sale have a tenacity of 9.0 to 9.5 g/d. Although many attempts to make stronger polyamide fibers are continued, satisfactory results have not been obtained yet.

Generally, in order to obtain high tenacity polyamide fibers or polyester fibers, polyamide polymer or polyester polymer having a high degree of polymerization must be spun into fibers and subsequently the spun fibers must be drawn at a high draw ratio. However, the melt viscosity of extruding polymers increases with increased degrees of polymerization of polymers, and as a result, the degree of orientation of spun fibers thus obtained increases and the stretchability of the spun fibers decreases. This feature is remarkable especially with polyhexamethylene adipamide whose crystallizing speed is notedly high.

On the other hand, Japanese patent application Kokoku No. 26207/1965 discloses a direct melt-spinning method for producing high tenacity Nylon fibers which comprises drawing polyhexamethylene adipamide spun fibers having a low degree of orientation in multiple steps. Furthermore, in order to obtain spun fibers having a low degree of orientation Japanese patent application Kokoku No. 7251/1964 proposes a method for controlling the atmospheric temperature below the spinning nozzle mounted on a spinhead in melt-spinning by providing a heating cylinder on the surface of the nozzle. By using these methods, the degree of orientation of spun fibers can be decreased and the spun fibers can be drawn at a high draw ratio and as a result, the tenacity of the drawn fibers is increased. Thus, with polyhexamethylene adipamide the tenacity of tire cords has been improved from 8 g/d to 9.0–9.5 g/d.

As the result of studies by the present inventors to increase the degree of polymerization, to attain high draw ratio and to obtain high tenacity of drawn fibers it has been found that drawn fibers having a tenacity of 10 g/d or more can be obtained. However, it has been found that the tenacity of such high tenacity drawn fibers having been subjected to twisting, weaving, adhesion-heat-treatment and vulcanization and subsequently having been taken out from the rubber is about 7 g/d which is the same as the tenacity of the commercially available polyhexamethylene adipamide fibers having a tenacity of 9.5 g/d having been subjected to the above described steps and subsequently having been taken out from the rubber. Also it has been found that decrease in tenacity of the fibers is remarkable in the vulcanization step, and that the attained effect on increasing the tenacity of the drawn fibers is not maintained at all. As the result of studies on high tenacity polyhexamethylene adipamide fibers having a less reduced tenacity in the after-treatments, especially in the vulcanization step, it has been found that increase in the thermal stability of elastic modulus of drawn fibers is very important.

DISCLOSURE OF THE INVENTION

Figure 1:
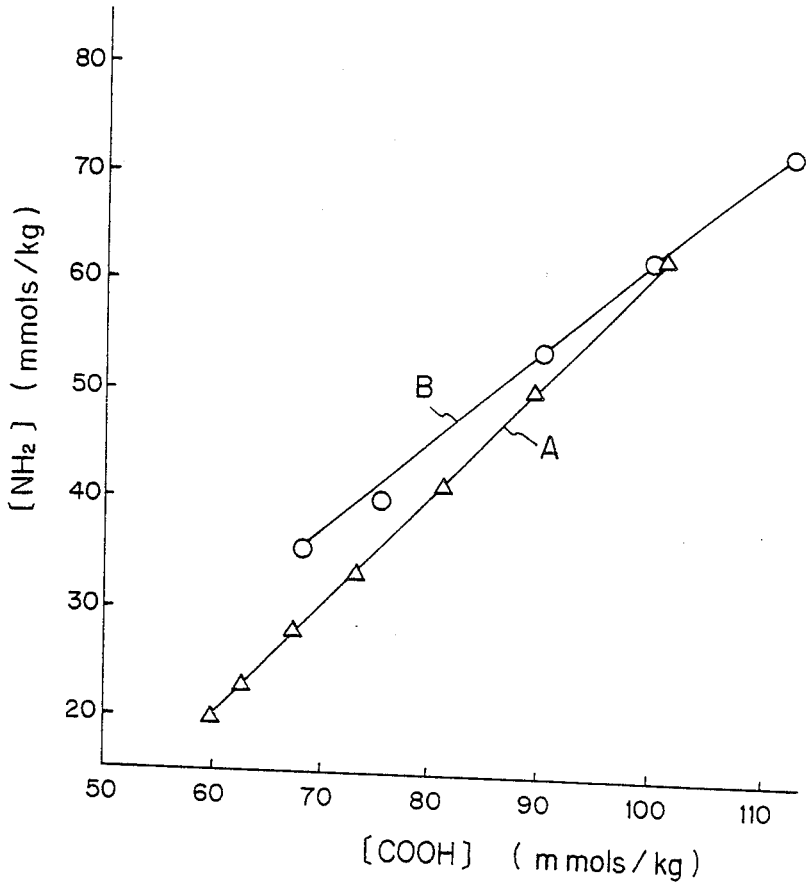
FIG. 1 shows graphs illustrating the changes of the terminal groups of polyhexamethylene adipamide in melt polymerization as curve B and in solid-phase polymerization as curve A.
Figure 2:
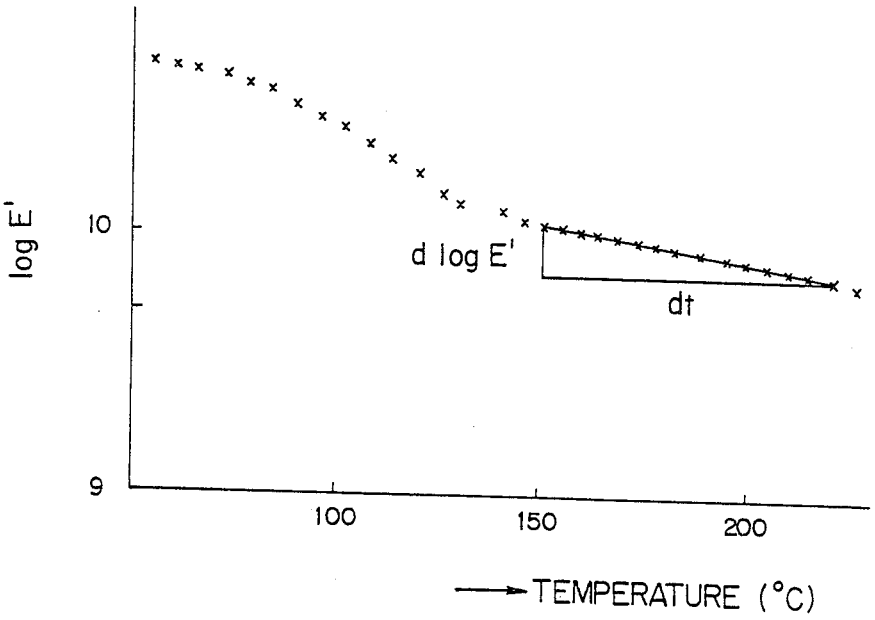
FIG. 2 is a graph illustrating the relationship between storage modulus E' measured by a "Vibron" and temperature, i.e., coefficient of stability of tie molecule.

According to this invention there are provided high tenacity polyhexamethylene adipamide fibers characteristically having:

(1) a formic acid relative viscosity of at least 70;
(2) a tenacity of at least 10 g/d; and
(3) a coefficient of stability of tie molecule of at most 0.20.

Conventional tire cord fibers are spun from the polymer having a formic acid relative viscosity of 60 to 70, polymerized by continuous or batch-wise melt polymerization of hexamethylenediammonium adipate. A spinning of the fibers has been carried out in a molten state of the polymer after said melt polymerization or after remelting of the polymer once chipped. After the fibers thus obtained are cooled and then once wound as spun fibers after adding an oiling agent, the fibers are finally drawn. As a more practical method, the fibers thus obtained are continuously cooled, added an oiling agent, subjected to stretching and heat-setting by the stretching means having multiple pairs of rollers and then finally wound as drawn fibers. (e.g. Japanese patent application Kokoku No. 32616/1973).

According to this invention there is provided a direct spinning and drawing process for producing high tenacity polyhexamethylene adipamide fibers by melt-spinning polyhexamethylene adipamide pellets to form spun fibers, cooling the spun fibers, adding an oiling agent to the cooled filaments, immediately taking up the oiled filaments with stretching means, for example rollers, especially a first pair of godet rollers, leading the filaments to pairs of godet rollers in multi-steps which are rotating at successively increased circumferential velocities to conduct multi-step drawing and heat-setting.

A process for providing the fibers of the present invention is characterized in that:

(a) A polymer having a formic acid relative viscosity of 75 to 150 obtained by the solid-phase polymerization of polyhexamethylene adipamide chips at a temperature of 180° C. to 240° C., said polyhexamethylene adipamide chips having formic acid relative viscosity of at most 70 and having been obtained by melt polymerization, is employed as the polyhexamethylene adipamide pellets;

(b) The drawing is conducted in at least two steps among stretching means, for example rollers, especially at least three pairs of godet rollers whose circumferential velocities are different from one another and the surface temperature of a pair of godet rollers which rotate at a highest circumferential velocity or at least one pair of godet rollers in a subsequent position is adjusted at a temperature of 220° C. to 250° C.;

(c) The drawing is conducted in such a manner as to satisfy the following formula:

$$5.2 \leqq DR \leqq 6.5$$

wherein DR is a product of the draw ratios in each drawing step; and (d) The winding is conducted in such a manner as to satisfy the following formula:

$$0.92 \geqq TS/GS \geqq 0.86$$

wherein TS is a winding speed and GS is a circumferential velocity of the pair of godet rollers having a highest circumferential velocity.

The polyhexamethylene adipamide fibers according to this invention comprise repeating units of the following formula:

$$-\underset{\underset{O}{\|}}{C}(CH_2)_4-\underset{\underset{O}{\|}}{C}NH(CH_2)_6NH-$$

and may comprise at most 10% by weight of other amide-forming units. Exemplary amide-formating units include units derived from aliphatic dicarboxylic acids such as sebacic acid and dodecanoic acid; aromatic dicarboxylic acids such as terephthalic acid and isophthalic acid; aliphatic diamines such as decamethylenediamine; aromatic diamines such as m-xylylenediamine; ω-amino acids such as ε-aminocaproic acid; and lactams such as caprolactam and laurinlactam. The above described hexamethylene adipamide which can be employed in this invention may also be incorporated with at most 20% by weight of other polyamides such as polycapronamide and polyhexamethylene sebacamide.

Furthermore, the above described polyhexamethylene adipamide fibers may contain conventional additives for polyamide such as thermal stabilizers such as copper acetate, copper chloride, copper iodide and mercaptobenzimidazole; light stabilizers such as manganese lactate and manganese hypophosphite; thickeners such as phosphoric acid, phenylphosphonic acid and sodium pyrophosphate; delustering agents such as titanium dioxide and kaolin; and plasticizers and lubricants such as methylenebisstearylamide and calcium stearate.

As a first characteristic feature of this invention the polyhexamethylene adipamide fibers of this invention have a formic acid relative viscosity of 70 to 150.

The term "formic acid relative viscosity" wherein means a solution relative viscosity at 25° C. of a 90% aqueous formic acid solution in which 8.4% by weight of a polymer is dissolved. Although high tenacity fibers can be prepared from a fiber having a formic acid relative viscosity of less than 70, the fibers thus obtained must be subjected to drawing at a high draw ratio and further their retention percentage of a tenacity utilization is disadvantageously reduced. On the other hand, the melt viscosity of an extruded polymer increases with increased formic acid relative viscosities and the degree of orientation of the spun fibers thus obtained becomes great and the stretchability of the fibers is deteriorated. This tendency is remarkable especially with polyhexamethylene adipamide having a remarkably high rate of crystallization. Thus, it is necessary that by elevating the melting temperature, reducing the spinning speed, providing a heating cylinder or controlling cooling conditions, the degree of orientation of spun fibers is decreased and the spun fibers are stretched to a greater extent. However, if the formic acid relative viscosity is too high, i.e., more than 150, the spun fibers whose degree of orientation has been reduced by the above described methods still have a high degree of orientation and cannot be stretched at a high draw ratio, and as a result, the tenacity cannot be increased. When the formic acid relative viscosity is more than 150, this phenomenon can be observed but in accordance with technical development on reduction in the degree of orientation of spun fibers it becomes possible to employ spun fibers having a high viscosity. A permissible formic acid relative viscosity which can be employed in this invention is from 70 to 150, and a preferable formic acid relative viscosity is from 70 to 100.

As a second characteristic feature of this invention, the polyhexamethylene adipamide fibers of this invention have a tenacity of at least 10 g/d. Commercially available polyhexamethylene adipamide fibers have a tenacity of around 9.5 g/d and in order to change the design of tires and to vary the number of plies or ends of fabrics embedded, it is necessary to increase the tenacity by at least 5% of the tenacity of the drawn fibers taking into account the coefficient of safety. Although the coefficient of stability of tie molecule of this invention may be imparted to the drawn fibers having a tenacity of 10 g/d or less may improve the retention percentage of a tenacity utilization in the after-treatments, the extent of improvement is smaller compared to that with the drawn fibers having a tenacity of at least 10 g/d according to the present invention. Furthermore, even if only the tenacity of drawn fibers are improved, when the fibers with low elongation are used i.e., low toughness (tenacity×elongation) of the drawn fibers, the energy for breaking the drawn fibers is disadvantageously reduced. At present, the toughness of commercially available polyhexamethylene adipamide fibers have a toughness of 190 g/d.% to 200 g/d.%. In this invention it is preferable that the toughness of polyhexmethylene adipamide fibers according to the present invention is at least 200 g/d.%.

The thermal stability of fibers, i.e. the retention percentage of elastic modulus in high temperature treatment can be estimated by the dependency of the storage modulus (E') on the temperature after the primary absorption, i.e., αa-absorption on the region of temperature closely related with the micro-brownian motion shown by the segments of high molecular weight chains which exist in the amorphous region. The storage modulus (E') can be defined as follows. In a measurement of dynamic viscoelasticity, when the stress employed to a fiber varies with a frequency having sine wave a strain of a fiber varies with a frequency. However, a phase of said strain losses δ comparing with a phase of said stress put to the fiber. When the phase of stress is divided into a component $\sigma'$ having a same phase as that of the strain and a component $\sigma''$ having a phase gaining 90° from that of the strain, it can be defined that $\sigma'/\gamma_o$ is a storage modulus (E') and $\sigma''/\gamma_o$ is a loss modulus (E''). Wherein $\gamma_o$ is the frequency amplitude of said strain. Generally, the storage modulus (E') can be measured by using a direct reading dynamic viscoelastmeter "Vibron DDV-IIC" manufactured by Toyo Baldwin. More specifically, the gradient of temperature of log E' after the αa-absorption, for example, with polyhexamethylene adipamide fibers, the gradient of temperature of log E' between 150° C. to 220° C., i.e., $-62.5[(d \log E')/dT]$ (wherein T is temperature) shows the stability of modulus to thermal hysteresis in the temperature range of 150° C. to 220° C., and reflects irreversible changes of the micro-structure in the amorphous region and the crystalline region. Thus it has been found that the value of $-d(\log E')/dT$ in the temperature range after the αa-absorption affects the retention percentage of tenacity in the vulcanization step which causes decrease in tenacity to the greatest extent among after-treatment-steps for manufacturing tire cords.

As a third characteristic feature of this invention, the polyhexamethylene adipamide fibers of this invention have a coefficient of stability of tie molecule of at most 0.20.

The term "coefficient of stability of tie molecule" herein means $-d(\log E')/dT$ in the range of 150° C. to 220° C. obtained by measuring an E'-temperature curve using an apparatus (manufactured by Toyo Baldwin, "Vibron DDV-IIC",) at a frequency of 110 Hz in dry air at a temperature increasing at the rate of 3° C./minute and plotting the measured values on a plotting semi-logarithm sheet. It is preferred that the coefficient of stability of tie molecule approaches zero. However, with coefficients of stability of tie molecule of at most 0.20, decrease in the tenacity of fibers is permissible. A preferred coefficient of stability of tie molecule is 0.15 or less. In order to lower the coefficient of stability of tie molecule, it is necessary to improve both polymers themselves and methods of spinning and drawing. Even if a polymer having a formic acid relative viscosity of 75 or more is melt-polymerized in the same manner as conventional polymers having a formic acid relative viscosity of less than 70, and subsequently the polymer obtained is subjected to spinning, drawing and heat-setting to form drawn fibers having a tenacity of 10 g/d or more, the coefficient of stability of tie molecule becomes 0.20 or more and accordingly, the tenacity in the after-treatments is greatly reduced. This may be estimated from the fact that due to the necessity for prolong the melting period to obtain a polymer having a high degree of polymerization, part of polyhexamethylene adipamide which is easy to thermally decompose is thermally decomposed during melting, resulting in a reduction in the coefficient of stability of tie molecule.

Generally, a process for providing highly polymerized polyhexamethylene adipamide polymer comprises (1) a condensation of an aqueous solution of hexamethylenediammonium adipate, (2) a polycondensation reaction under high pressure to prevent an evaporation of hexamethylenediamine, (3) a separation of excess steam after reducing to atmospheric pressure and (4) a post polymerization under reduced pressure more than atmospheric pressure. However, when the polyhexamethylene adipamide polymer is polymerized in a process of said post polymerization, especially long-period post polymerization for providing highly polymerized polyhexamethylene adipamide, the polymer thus obtained is suffered from a thermal decomposition, and thus the fibers spun from said polymer and drawn are remarkably reduced their tenacity during after-treatment. As the result of studies according to the present invention, it has been found that the polymer having less thermal decomposition can be obtained by a solid-phase polymerization of a polymer having a formic acid relative viscosity of at least 75 instead of a melt polymerization as a process of said post polymerization (see, FIG. 1). Thus, the fibers spun from said polymer having less thermal decomposition and drawn are less reduced tenacity during after-treatment.

Namely, a 50% by weight aqueous solution of hexamethylenediammonium adipate is condensed to the concentration of 70% in a condenser and then the condensate is led to a first reactor. The internal temperature of the first reactor is raised to 250° C. from 220° C. over 1.5 hours while the internal pressure is maintained at 17.5 Kg/cm$^2$. Subsequently the reaction mixture is transferred to a second reactor and the internal pressure of the second reactor is reduced to atmospheric pressure over 20 minutes while the internal temperature of the second reactor is raised to 280° C. The reaction mixture is led to a vapor-liquid separator and steam is removed therefrom and the residue is partly passed through a three-way cock and extruded as a rope through a spinning nozzle and then the rope is cooled with water and cut into chips (I). The above described residue is partly passed through the three-way cock, led to a post polymerization reactor, polymerized at 350 mmHg at 280° C. for 15 minutes, and then the polymer is extruded as a rope through a spinning nozzle and then the rope is cooled with water and cut into chips (II). The polymer formed is sampled from sampling nozzles equipped in front of and at the back of the post polymerization reactor in the melt polymerization step, and the amounts of terminal [COOH] groups and the terminal [$NH_2$] groups of the polymer obtained are measured and illustrated as curve B in FIG. 1. More specifically, the formic acid relative viscosity of chips (I) is 29.7, the amounts of terminal [COOH] groups of them and terminal [$NH_2$] groups of them are 101.5 mmols/Kg and 62.5 mmols/Kg, respectively. In a tumbler-type solid-phase polymerization reactor, 5000 parts by weight of chips (I) are polymerized at a jacket temperature of 200° C. in a nitrogen stream at a flow rate of nitrogen of 3 l/hour/-polymer Kg. In the course of the solid-phase polymerization sampling is carried out, and the amounts of terminal [COOH] groups and terminal [$NH_2$] groups of the sampled chips are measured and illustrated as curve A in FIG. 1.

As will be understood from FIG. 1, a nearly equivalent amount of terminal [COOH] groups and terminal

[$NH_2$] groups is decreased in the solid-phase polymerization in the progress of polymerization.

On the other hand, in the melt polymerization decrease in the amount of terminal [$NH_2$] groups is smaller. This shows decrease in the amount of terminal [COOH] and [$NH_2$] groups accompanying the polycondensation and increase in the amount of terminal [$NH_2$] groups caused by the thermal decomposition of polyhexamethylene adipate as shown below.

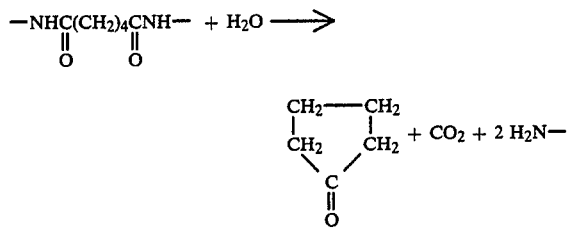

The polymer having undergone such thermal decomposition forms a secondary amine and a tertiary amine by the ammonium-elimination reaction of amines of terminal groups, resulting in a cross-linked structure in addition to the above-described reaction. Thus it is considered that the thermal stability of polyhexamethylene adipamide fibers prepared from such a polymer is decreased and that the tenacity in the after-treatment step is remarkably reduced.

In order to obtain polyhexamethylene adipamide fibers having low coefficient of stability of tie molecule, it is necessary to employ a polymer of less thermal decomposition, and increase in the degree of polymerization by solid-phase polymerization is necessary.

In order to obtain polyhexamethylene adipamide having a high degree of polymerization and a coefficient of stability of tie molecule of at most 0.20, it is required that a polymer which has been melt-polymerized to a formic acid relative viscosity of at most 70, preferably at most 50 is formed into chips and that subsequently the obtained chips are polymerized again in solid-phase at a temperature of 180° to 240° C. so as to adjust the formic acid relative viscosity of 75 to 150. When temperatures of lower than 180° C. are used in the solid-phase polymerization, a long period of the solid-phase polymerization time is necessary and moreover, the stretchability of the spun fibers obtained from the polyhexamethylene adipamide pellets is decreased. A preferred solid-phase polymerization temperature is at least 190° C. On the other hand, solid-phase polymerization temperatures of 240° C. or higher are not permissible because of the adhesion of pellets by fusion and the decrease in the stretchability of fibers. Accordingly, a preferred solid-phase polymerization temperature is at most 210° C. Furthermore, the formic acid relative viscosity of the polyhexamethylene adipamide pellets after the solid-phase polymerization is necessary 75 to 150. When spun fibers such as tire cords are subjected to a critical stretching for spun fibers, a relative viscosity of drawn fibers decreases as compared with spun fibers, because of scissions of polymer chains. Accordingly, if a formic acid relative viscosity of drawn fibers is at least 70, it is required that a formic acid relative viscosity of pellets polymerized by solid-phase polymerization is at least 75. Namely, high tenacity fibers may be prepared from the pellets having a formic acid relative viscosity of less than 75. However, drawing at a higher draw ratio is necessary and the retention percentage of tenacity in the after-treatments is disadvantageously decreased. If the formic acid relative viscosity is excessively increased, the melt viscosity of extruded polymers is also increased. As a result, the degree of orientation of the obtained spun fibers is increased too much and the stretchability of the fibers is decreased, and accordingly, the fibers having sufficient tenacity and elongation cannot be obtained. This phenomenon is remarkable at a formic acid relative viscosity of more than 150. A permissible formic acid relative viscosity of polyhexamethylene adipamide pellets after the solid-phase polymerization is 75 to 150, and a preferred formic acid relative viscosity is 75 to 100.

Japanese patent application Kokoku No. 32616/1973 discloses a method for producing high tenacity polyhexamethylene adipamide fibers. However, even if a polymer having a formic acid relative viscosity of 75 to 150 is directly spun and drawn by the process as disclosed in the Japanese patent application Kokoku No. 32616/1973, fibers having low coefficient of stability of tie molecule can hardly be obtained. In order to obtain fibers having low coefficient of stability of tie molecule, it is required that the drawn fibers are subjected to heat-setting at high temperatures to reduce the shrinkage percentage of the fibers and to stabilize the thermal structure of the fibers. A permissible shrinkage percentage of the fibers at 160° C. in dry heat for 30 minutes without any load is at most 4%. A preferred shrinkage percentage is at most 3%. When the shrinkage percentage is more than 4%, the coefficient of stability of tie molecule becomes 0.20 or more and the retention percentage of tenacity in the after-treatments is decreased even with use of the polymer which is obtained by the solid-phase polymerization and less thermal decomposition.

There are a method for drawing and heat-setting the spun fibers which have been wound as unstretched fibers and a method for directly spinning, drawing and heat-setting spun fibers as the spinning method for obtaining low shrinkage fibers. However, in the process for producing drawn fibers having such a high formic acid relative viscosity as employed in the present invention, the shrinkage percentage of the fibers is increased and accordingly, heat-setting at higher temperatures, for example, at a temperature of at least 220° C. is required and the relax percentage must be increased. Thus it is preferred to employ direct spinning, drawing and high temperature heat-setting in this invention.

In the steps of spinning, drawing and high temperature heat-setting according to the present invention, stretching means, for example rollers, especially a pair of godet rollers which are both positively driven or one of which is positively driven and the other is negatively driven may be used. It is necessary that the surface temperature of at least one pair of godet rollers which are rotating at a highest circumferential velocity or that of at least one pair of godet rollers among the successive pairs of godet rollers is at least 220° C. Even if fibers are spun and then drawn under the conditions satisfying the above described (a), (c) and (d) according to the present invention, the shrinkage percentage of drawn fibers becomes at least 4% and the coefficient of stability of tie molecule becomes at least 0.20, and then the tenacity during the after-treatments is greatly reduced, if there is no pair of godet rollers which are rotating at the highest circumferential velocity and whose surface temperature is at least 220° C. or no pair of godet rollers whose surface temperature is at least 220° C. among the successive pairs of godet rollers.

On the other hand, when the surface temperature of the above described pairs of the godet rollers is higher than 250° C., fibers are broken by fusion and the broken fibers disadvantageously adhere onto the godet rollers.

If the product of the draw ratios of the godet rollers in each step is 5.2 or less, the drawn fibers having a tenacity of at least 10 g/d cannot be obtained. An orientation of spun fibers highly depends on a spinning speed of spun fibers. Namely, an orientation of spun fibers increases with the increased spinning speed and decreases with the decreased spinning speed. Accordingly, the lower draw ratios at the higher spinning speed and the higher draw ratios at the lower spinning speed are required to obtain the same tenacity. Accordingly, the draw ratio changes depending upon the spinning speed employed, the draw ratio should be determined in such a range that drawn fibers have a tenacity of at least 10 g/d, few breakage of fibers hardly occurs and spinning is stabilized. If the spun fibers are subjected to stretching at draw ratios of at least 6.5 at a general spinning speed, the draw ratios of spun fibers exceeds their critical draw ratios, and the drawn fibers are broken. The critical draw ratios of spun fibers increases with a decreased orientation of spun fibers caused by the decreased spinning speed. Accordingly, although the product of the draw ratios may be 6.5 or more, the spinning speed is extremely decreased, resulting in a disadvantageously low productivity.

When the winding speed is designated as TS and the circumferential velocity of a pair of godet rollers rotating at a highest circumferential velocity is designated as GS, it is preferred that the ratio of TS/GS is 0.86 to 0.92. If the ratio is higher than 0.92, winding-tension is increased. On the other hand, if the ratio is less than 0.86, winding-tension is decreased and as a result, good winding cannot be conducted.

Although the drawn fibers according to the present invention have tenacity as high as at least 10 g/d or more, reduction in the tenacity of the fibers having undergone twisting, weaving, adhesion-heat treatment and vulcanization steps is small. Accordingly, the fibers are useful for reinforcement of products such as tire cords and belts which require high tenacity. The fibers are useful for reinforcement of tires for construction-vehicles, airplanes and truck-buses which require a large amount of filaments and a large number of plies or ends of embedded fabrics.

The present invention will now be illustrated in more detail by the following examples which are given for illustrative purposes only and are not to be construed as limiting the invention.

In the following examples, the amount of terminal amino groups herein means a point of neutralization measured by subjecting 50 ml of a 90% by weight aqueous phenol solution in which 6.0 g of polymer have been dissolved to potential titration with 1/20N hydrochloric acid using a TOA pH meter model HM-20E. The amount of carboxyl terminal groups means a point of neutralization measured by subjecting 50 ml of benzyl alcohol in which 4.0 g of polymer have been dissolved under heating to neutralization titration with 1/10N sodium hydroxide and phenolphthalene as the indicator.

Tenacity and elongation are measured by using a tensile testing machine, "Autograph S-100" manufactured by Shimadzu Seisakusho, with a filament having twists of 80 turns/meter and an initial length of 25 cm at a dropping speed of 30 cm/minute and at a chart speed of 30 cm/minute with a full-scale of 25 Kg. Shrinkage percentage in dry heat is measured by subjecting filaments of 1.0 m having twists of 80 turns/meter to shrinking without any load in an air oven at 160° C. for 30 minutes.

EXAMPLE 1

A 50% by weight aqueous solution of hexamethylenediammonium adipate was constantly supplied to a condenser at a rate of 2000 parts by weight/hour, condensed to the concentration of 70% by weight and then led to a first reactor. The internal temperature of the first reactor was raised from 220° C. to 250° C. over 1.5 hours while the internal pressure was maintained at 17.5 Kg/cm$^2$. Subsequently the reaction mixture was led to a second reactor and the internal pressure of the second reactor was reduced to atmospheric pressure over 20 minutes while the internal temperature of the second reactor was raised to 280° C. After steam was removed in a vapor-liquid separator, the residue was spun as a rope through a spinning nozzle and then the rope was cooled with water and cut into chips. The formic acid relative viscosity of the chips was 29.7, the terminal [COOH] group value was 101.5 mmols/Kg and the terminal [$NH_2$] group value was 62.5 mmols/Kg. Then 5000 parts by weight of the chips thus obtained were polymerized in a tumbler-type solid polymerization reactor at the jacket temperature of 210° C. in nitrogen gas stream having a flow rate of 3 /hour/-polymer Kg. After 7.25 hours, the polymers formed were cooled and taken out of the polymerization reactor to give chips having a formic acid relative viscosity of 90.0, a terminal [COOH] group value of 62.7 mmols/Kg and a terminal [$NH_2$] group value of 23.0 mmols/Kg. The chips thus obtained were extruded from a spinning nozzle having 312 holes of 0.27 mm in diameter at 303° C., and the filaments thus spun were passed through a cylindrical heater of 150 mm in length whose temperature was adjusted at 350° C. and then cooled. Subsequently, after adding an oiling agent, the filaments were immediately taken up with a first pair of godet rollers, and then led successively to a second pair of godet rollers, a third pair of godet roller and a fourth pair of godet rollers which were rotating at successively increased circumferential velocities, and subsequently subjected to drawing and heat-setting in three steps, and finally wound at a winding speed of 1,500 m/min. The temperatures of the four sets of the godet rollers $G_1$, $G_2$, $G_3$ and $G_4$ were adjusted at 80° C., 210° C., 230° C. and 250° C., respectively. The ratios of the circumferential velocities of $G_2/G_1$, $G_3/G_2$, $G_4/G_3$ and winding speed/$G_3$ were 3.63, 1.67, 0.995 and 0.886, respectively. Namely, $G_3/G_1$ was 6.06. The filaments thus obtained had 1890$^d$/312f, a formic acid relative viscosity of 83.0, a tenacity of 10.4 g/d, an elongation of 21.0% i.e. a toughness of 218.4 g/d.%, a shrinkage percentage in dry heat of 2.0% and a coefficient of stability of tie molecule of 0.09.

The filaments were subjected to twisting of 32.0×32.0 turns/10 cm to form raw cords of 1,890 d/2. Subsequently, the raw cords were subjected to dipping treatment in a resorcin-formalin latex by using Computreater manufactured by Litzler in a first zone at 160° C. under a tension of 2.0 Kg/cord for 140 seconds; in a second zone at 230° C. under a tension of 3.8 Kg/cord for 40 seconds; and in a third zone at 230° C. under a tension of 2.6 Kg/cord for 40 seconds. The amount of the latex adhered was 4.5% by weight.

The cords thus obtained were embedded in the rubber of carcass and vulcanized with no load at 190° C. for 30 minutes. Then, the vulcanized rubber was broken to take out the cords. The tenacity of the cords was measured and was 7.9 g/d and the retention percentage of tenacity of the vulcanized cords was 76.0%.

COMPARATIVE EXAMPLE 1

A 50% by weight aqueous solution hexamethylenediammonium adipate was constantly supplied to a condenser at a rate of 2000 parts by weight/hour to condense the concentration to 70% by weight and then led to a first reactor. The internal temperature of the first reactor was raised to 250° C. from 220° C. over 1.5 hours while the internal pressure was maintained at 17.5 $Kg/cm^2$. Subsequently the reaction mixture was led to a second reactor and the internal pressure of the second reactor was reduced to atmospheric pressure over 20 minutes while the internal temperature of the second reactor was raised to 280° C. After steam was removed in a vapor-liquid separator, the residue was polymerized in a polymerization reactor at 200 mmHg at 280° C. for 15 minutes, and spun through a spinning nozzle as a rope. Then the rope was cooled with water and cut into chips. The chips had a formic acid relative viscosity of 78.7, a terminal [COOH] group value of 58.6 mmols/Kg and a terminal $[NH_2]$ group value of 33.4 mmols/Kg. The chips thus obtained were extruded from a spinning nozzle having 312 holes of 0.27 mm in diameter at 298° C., and the filaments thus spun were passed through a cylindrical heater of 150 mm in length whose temperature was adjusted at 310° C. and then cooled. After adding an oiling agent, the filaments were immediately taken up with a first pair of godet rollers, and then led to a second pair of godet rollers, a third pair of godet rollers and a fourth pair of godet rollers which were rotating at successively increased circumferential velocities, subsequently subjected to drawing and heat-setting in three steps, and finally wound at a winding speed of 1500 m/min. The temperatures of the four sets of the godet rollers $G_1$, $G_2$, $G_3$ and $G_4$ were adjusted at 80° C., 210° C., 230° C. and 230° C., respectively. The ratios of the circumferential velocities of $G_2/G_1$, $G_3/G_2$, $G_4/G_3$ and winding speed/$G_3$ were 3.63, 1.67, 0.995 and 0.886, respectively. Namely, $G_3/G_1$ was 6.06. The filaments thus obtained had a formic acid relative viscosity of 74.0, a tenacity of 10.3 g/d, an elongation of 21.5% i.e., a toughness of 221.5 g/d.%, a shrinkage percentage in dry heating of 2.7% and a coefficient of stability of tie molecule of 0.21.

In the same manner as in Example 1, the filaments were formed into raw cords and then the raw cords were subjected to dipping treatment and vulcanization, and the tenacity of the vulcanized cords which had been taken out of the rubber was measured. As a result, the tenacity of the vulcanized cords was 7.2 g/d and the retention percentage of tenacity of the vulcanized cords was 69.9%.

COMPARATIVE EXAMPLE 2

A 50% by weight aqueous solution of hexamethylenediammonium adipate was constantly supplied to a condenser at a rate of 2000 parts by weight/hour to condense the concentration to 70% by weight and then led to a first reactor. While the internal pressure of the first reactor was maintained at 17.5 $Kg/cm_2$, the internal temperature of the first reactor was raised to 250° C. from 220° C. over 1.5 hours. Subsequently, the reaction mixture was led to a second reactor and the internal pressure of the second reactor was reduced to atmospheric pressure over 20 minutes while the internal temperature of the second reactor was raised to 280° C. After steam was removed in a vapor-liquid separator, the residue was polymerized in a polymerization reactor at 350 mmHg at 280° C. for 15 minutes and spun through a spinning nozzle as a rope. Then the rope was cooled with water and cut into chips. The chips had a formic acid relative viscosity of 67.0, a terminal [COOH] group value of 65.9 mmols/Kg and a terminal $[NH_2]$ group value of 34.1 mmols/Kg. The chips thus obtained were extruded from a spinning nozzle having 213 holes of 0.27 in diameter at 298° C., and immediately cooled. After adding an oiling agent, the filaments were immediately taken up with a first pair of godet rollers, and then led to a second pair of godet rollers, a third pair of godet rollers and a fourth pair of godet rollers successively which were rotating at successively increased circumferential velocities, subsequently subjected to drawing and heat-setting in three steps, and finally wound at a winding speed of 1900 m/min. The temperatures of the four sets of the godet rollers $G_1$, $G_2$, $G_3$ and $G_4$ were adjusted at room temperature, 70° C., 215° C. and 215° C., respectively. The ratios of the circumferential velocities of $G_2/G_1$, $G_3/G_2$, $G_4/G_3$, winding speed/$G_4$ were 1.05, 3.24, 1.65 and 0.91, respectively. Namely, $G_4/G_1$ was 5.61. The filaments thus obtained had a formic acid relative viscosity of 62.0, a tenacity of 9.4 g/d, an elongation of 20.8%, i.e. a toughness of 195.5 g/d.%, a shrinkage percentage in dry heat of 3.5% and coefficient of stability of tie molecule of 0.15.

In the same manner as in Example 1, the filaments were formed into raw cords and then the raw cords were subjected to dipping treatment and vulcanization, and the tenacity of the vulcanized cords which had been taken out of the rubber was measured. As a result, the tenacity of the vulcanized cords was 7.0 g/d and the retention percentage of tenacity of the vulcanized cords was 74.5%.

EXAMPLE 2

By using the same chips having low viscosity as obtained in Example 1 (i.e., formic acid relative viscosity: 29.7), solid-phase polymerization was conducted for 6.5 hours in the same manner as in Example 1 to give chips having a formic acid relative viscosity of 79.0. The chips thus obtained were spun into filaments, and the filaments were subjected to drawing and heat-setting in the same manner as in Comparative Example 1. The filaments thus obtained had a formic acid relative viscosity of 74.1, a tenacity of 10.3 g/d, an elongation of 21.7%, i.e. a toughness of 223.5 g/d.%, a shrinkage percentage in dry heat of 2.6% and a coefficient of stability of tie molecule of 0.13. The filaments were formed into raw cords and then the raw cords were subjected to dipping treatment and vulcanized in the same manner as in Example 1. The tenacity of the vulcanized cords which had been taken out from the rubber was measured. As a result, the tenacity of the vulcanized cords was 7.6 g/d and the retention percentage of tenacity of the vulcanized cord was 73.8%.

EXAMPLE 3

By using the same chips having the low viscosity as obtained in Example 1 (i.e., formic acid relative viscosity: 29.7), solid-phase polymerization was conducted for 6 hours and 50 minutes in the same manner as in Example 1 to give chips having a formic acid relative viscosity of 83.6. The chips thus obtained were melt-spun from a spinning nozzle having 312 holes of 0.24 mm in diameter at 298° C. to give filaments. Then the filaments thus spun were passed through a cylindrical heater of 200 mm in length whose temperature was adjusted at 320° C., and cooled. Subsequently, after adding an oiling agent, the filaments were immediately taken up with a first pair of godet rollers, and then led successively to a second pair of godet rollers, a third pair of godet rollers and a fourth pair of godet rollers which were rotating at successively increased circumferential velocities, subsequently subjected to drawing and heat-setting in three steps, and finally were wound at a winding speed of 1800 m/min. The temperatures of the four sets of godet rollers, $G_1$, $G_2$, $G_3$ and $G_4$ were adjusted at 80° C., 210° C., 230° C. and 230° C., respectively. The ratios of the circumferential velocities of $G_2/G_1$, $G_3/G_2$, $G_4/G_3$ and winding speed/$G_3$ were 3.50, 1.70, 0.995 and 0.886, respectively. Namely, $G_3/G_1$ was 5.95. The filaments thus obtained had a formic acid relative viscosity of 78.4, a tenacity of 10.5 g/d, an elongation of 20.6%, i.e. a toughness of 216.3 g/d.%, a shrinkage percentage in dry heat of 2.5% and a coefficient of stability of tie molecule of 0.12.

The filaments were formed into raw cords and then the raw cords were subjected to dipping treatment and vulcanization in the same manner as in Example 1, and the tenacity of the vulcanized cords which had been taken out from the rubber was measured. As a result, the tenacity of the vulcanized cords was 7.9 g/d and the retention percentage of tenacity of the vulcanized cords was 75.2%.

EXAMPLE 4

By using the same chips as obtained in Comparative Example 2 (i.e., formic acid relative viscosity: 67.0), solid-phase polymerization was conducted for 4.5 hours in the same manner as in Example 1 to give chips having a formic acid relative viscosity of 85.7. The chips thus obtained were spun into filaments, and the filaments were subjected to drawing and heat-setting in the same manner as in Example 3. The filaments thus obtained had a formic acid relative viscosity of 80.2, a tenacity of 10.5 g/d, an elongation of 20.5%, a toughness of 215.3 g/d.%, a shrinkage percentage in dry heat of 2.6% and a coefficient of stability of tie molecule of 0.15.

The filaments were formed into raw cords and then the raw cords were subjected to dipping treatment and vulcanized in the same manner as in Example 1. The tenacity of the vulcanized cords which had been taken out from the rubber was measured. As a result, the tenacity of the vulcanized cords was 7.6 g/d and the retention percentage of tenacity of the vulcanized cords was 72.4%.

COMPARATIVE EXAMPLE 3

The same chips as obtained by the solid-phase polymerization in Example 4 (i.e., formic acid relative viscosity: 85.7) were extruded from a spinning nozzle having 312 holes of 0.27 mm in diameter at 298° C. to give filaments. The filaments thus obtained were passed through a cylindrical heater of 200 mm in length whose temperature was adjusted at 320° C. and then were cooled. After adding an oiling agent, the filaments were immediately taken up with a first pair of godet rollers, and led to a second pair of godet rollers, a third pair of godet rollers and a fourth pair of godet rollers successively which are rotating at successively increased circumferential velocities, subsequently subjected to drawing and heat-setting in three steps and finally were wound at a winding speed of 1800 m/min. The temperatures of the four sets of the godet rollers $G_1$, $G_2$, $G_3$ and $G_4$ were adjusted at room temperature, 70° C., 215° C. and 215° C., respectively. The ratios of the circumferential velocities of $G_2/G_1$, $G_3/G_4$, $G_4/G_3$ and winding speed/$G_4$ were 1.05, 3.43, 1.65 and 0.91, respectively. Namely, $G_4/G_1$ was 5.94. The filaments thus obtained had a formic acid relative viscosity of 80.2, a tenacity of 10.5 g/d, an elongation of 18.9%, a toughness of 198.5 g/d.%, a shrinkage percentage in dry heat of 4.7% and a coefficient of stability of tie molecule of 0.21.

The filaments were formed into raw cords and then the raw cords were subjected to dipping treatment in the same manner as in Example 1 and vulcanized. The tenacity of the vulcanized cords which had been taken out from the rubber was measured. As a result, the tenacity of the vulcanized cords was 7.1 g/d and retention percentage of tenacity of the vulcanized cords was 67.6%.

EXAMPLE 5

By using the same chips as obtained in Comparative Example 2 (i.e., formic acid relative viscosity: 67.0), solid-phase polymerization was conducted at varied temperatures for varied periods of polymerization time as shown in Table 1.

The chips thus obtained were spun into filaments from a spinning nozzle having 312 holes of 0.24 in diameter at 298° C. The filaments thus obtained were passed through a cylindrical heater of 200 mm in length whose temperature was adjusted at 320° C. and then cooled. After adding an oiling agent, the filaments were immediately taken up with a first pair of godet rollers. Subsequently the filaments were led to a second pair of godet rollers, a third pair of godet rollers and a fourth pair of godet rollers successively which were rotating at successively increased circumferential velocities, and subsequently subjected to drawing and heat-setting in three steps and finally wound at a winding speed of 1800 m/min. The temperatures of the four sets of the godet rollers $G_1$, $G_2$, $G_3$ and $G_4$ were adjusted at a temperature of 80° C., 210° C., 230° C. and 230° C., respectively. Since the ratio of the circumferential velocities of one pair of godet rollers to another pair of godet rollers was changeable depending upon drawability of each type of chips, the ratios of the circumferential velocities of $G_3/G_2$, $G_4/G_3$ and winding speed/$G_3$ were fixed at 1.70, 1.000 and 0.886, respectively, and only the circumferential velocity of the godet rollers $G_1$ was changed depending each type of chips. The circumferential velocity of the godet rollers $G_1$ was determined in such a manner that a maximum draw ratio $G_3/G_1$ which could be attained by continuous drawing for 10 minutes minus 0.2 was made to be the ratio of $G_3/G_1$. Thus the filaments were drawn and heat-set. The results are shown in Table 2.

TABLE 1

| Chip | Temperature of Solid-phase Polymerization (°C.) | Period of Solid-phase Polymerization (hours) | Formic Acid Relative Viscosity |
|---|---|---|---|
| A | 170 | 12.3 | 89.0 |
| B | 180 | 7.2 | 88.8 |
| C | 190 | 5.6 | 85.3 |
| D | 200 | 4.6 | 88.0 |
| E | 210 | 3.5 | 95.8 |

TABLE 2

| Chip | Formic Acid Relative Viscosity | Total Draw Ratio ($G_3/G_1$) | Tenacity (g/d) | Elongation (%) | Toughness (g/d. %) |
|---|---|---|---|---|---|
| A | 83.0 | 5.55 | 9.5 | 21.3 | 202.3 |
| B | 83.0 | 5.80 | 10.1 | 21.2 | 214.1 |
| C | 79.8 | 5.90 | 10.3 | 20.9 | 215.3 |
| D | 82.5 | 5.95 | 10.5 | 20.7 | 217.4 |
| E | 90.1 | 5.85 | 10.4 | 21.0 | 218.4 |

From Table 2 it can be understood that with decreased temperatures of solid-phase polymerization, not only the period of solid-phase polymerization increases but also the drawability of the spun filaments decrease.

EXAMPLE 4

By using the same chips having the low viscosity (i.e., formic acid relative viscosity: 29.7) as obtained in the same manner as in Example 1, solid-phase polymerization was conducted for 8 hours and 50 minutes in the same manner as in Example 1 to give chips having a formic acid relative viscosity of 116.7. The chips thus obtained were melt-spun from a spinning nozzle having 208 holes of 0.24 mm in diameter at 310° C., and the filaments thus obtained were passed through a cylindrical heater of 350 mm in length whose temperature was adjusted at 350° C. and then cooled. Subsequently, after adding an oiling agent, the filaments were immediately taken up with a first pair of godet rollers, and then were led to a second pair of godet rollers, a third pair of godet rollers and a fourth pair of godet rollers successively which were rotating at successively increased circumferential velocities, subsequently subjected to drawing and heat-setting in three steps, and finally wound at a winding speed of 2100 m/min. The temperatures of the four sets of the godet rollers $G_1$, $G_2$, $G_3$ and $G_4$ were adjusted at 80° C., 210° C., 230° C. and 230° C., respectively. The ratios of the circumferential velocities of $G_2/G_1$, $G_3/G_2$, $G_4/G_3$ and winding speed/$G_3$ were 3.35, 1.67, 1.00 and 0.880, respectively. Namely, $G_3/G_1$ was 5.60. The filaments thus obtained had a formic acid relative viscosity of 96.3, a tenacity of 10.3 g/d, an elongation of 20.3%, i.e. a toughness of 209.1 g/d.%, a shrinkage percentage in dry heat of 2.9% and a coefficient of stability of tie molecule of 0.15.

The filaments were formed into raw cords and then the raw cords were subjected to dipping treatment and vulcanization in the same manner as in Example 1, and the tenacity of the vulcanized cords which had been taken out from the rubber was measured. As a result, the tenacity of the vulcanized cords was 7.6 g/d and the retention percentage of the vulcanized cords was 73.8%.

As illustrated in the above described examples and comparative examples, even if drawn filaments having a formic acid relative viscosity of 70 or more and a tenacity of 10 g/d or more were directly spun and drawn by the method as described in Japanese patent application Kokoku No. 32616/1973, it is impossible to obtain spun filaments having a low coefficient of stability of tie molecule. On the other hand, according to this invention it is possible to obtain filaments having a low coefficient of stability of tie molecule in addition to improved low shrinkage by heat-setting at high temperatures and increased degree of polymerization by supressing decomposition of polymers by using solid-phase polymerization. Further, cords having high retention percentage of a tenacity even after after-treatments such as twisting, dipping treatment and vulcanization, i.e., cords having high tenacity after vulcanization can be obtained only by using the filaments having low coefficient of stability of tie molecule. Thus the number of plies or ends of embedded fabrics in tires or belts can be reduced by using the filaments of the present invention.

What is claimed is:

1. A high tenacity polyhexamethylene adipamide fiber having:

(a) a formic acid relative viscosity of at least 70;

(b) a tenacity of at least 10 g/d;

(c) a toughness of at least 200 g/d %;

(d) a shrinkage percentage of at most 4% with no load at 160° C. in dry heat for 30 minutes;

(e) a coefficient of stability of tie molecule of at most 0.20; and (f) an elongation of at least 19%.

2. The fiber of claim 1 wherein the formic acid relative viscosity is 75 to 100.

3. The fiber of claim 1, wherein the coefficient of stability of tie molecule is at most 0.15.

4. The fiber according to claim 1, wherein the toughness is at least 125 g/d.%.

5. The fiber of claim 1, wherein the shrinkage percentage with no load at 160° C. in dry heat for 30 minutes is at most 3%.

* * * * *

UNITED STATES PATENT AND TRADEMARK OFFICE

CERTIFICATE OF CORRECTION

PATENT NO. : 4,758,472

DATED : July 19, 1988

INVENTOR(S) : Kazuyuki Kitamura

It is certified that error appears in the above-identified patent and that said Letters Patent is hereby corrected as shown below:

Col. 5, line 42, delete "-d(log E')/dT" and insert therefor --

-62.5[(d log E')/dT] --

Signed and Sealed this

Twenty-third Day of October, 1990

*Attest:*

HARRY F. MANBECK, JR.

*Attesting Officer*

*Commissioner of Patents and Trademarks*